United States Patent [19]

Rickmers

[11] 4,015,308

[45] Apr. 5, 1977

[54] VACUUM BLEED SYSTEM FOR A VACUUM CLEANER OR THE LIKE

[75] Inventor: Clifford P. Rickmers, North Canton, Ohio

[73] Assignee: The Hoover Company, North Canton, Ohio

[22] Filed: Oct. 29, 1975

[21] Appl. No.: 626,744

[52] U.S. Cl. ..... 15/339; 15/327 R; 137/637.1

[51] Int. Cl.[2] ..... A47L 9/00

[58] Field of Search ..... 15/327 R, 327 A, 327 E, 15/339; 137/637.1, 637

[56] References Cited

UNITED STATES PATENTS

| | | | |
|---|---|---|---|
| 3,353,452 | 11/1967 | Beck | 137/637.1 X |
| 3,566,921 | 3/1971 | Bell | 15/339 X |
| 3,633,239 | 1/1972 | Meyerhoefer | 15/339 X |
| 3,779,283 | 12/1973 | Hohulin | 15/327 R X |

*Primary Examiner*—Christopher K. Moore

[57] ABSTRACT

A floor care appliance is provided in which suction pressure (vacuum) of cleaner suction air may be discretely modified in a series of steps by selective stages of bleed of atmospheric air into the dirt-collecting bag containing partial vacuum chamber. A multi-pushbutton ensemble activates directly, movable valve members, permanently attached to pushbuttons, which port or close off or obstruct an aperture in the housing or a tunnel arrangement leading to the aperture and communicating with ambient air pressure.

15 Claims, 9 Drawing Figures

VACUUM BLEED SYSTEM FOR A VACUUM CLEANER OR THE LIKE

BACKGROUND OF THE INVENTION

1. Field of the Invention

This invention relates to floor care appliances having a flow of suction air and, more specifically, relates to a floor care appliance wherein suction air pressure may be modified by a variable selective bleed of atmospheric air.

2. Description of the Prior Art

Selective variation of floor care appliance suction pressure, broadly, is old and well known, having appeared in the prior art as early as 1936, for example. Steady improvement and development of this idea has now yielded atmospheric bleed mechanisms which utilize manually actuatable means in a button form so as to improve operator initiated actuation; that is, easy pushbutton operation of a vacuum bleed system has now been provided. Recent examples of this development can be seen in U.S. Pat. No. 3,566,921, issued on Mar. 2, 1971, and U.S. Pat. No. 3,633,239, issued on Jan. 11, 1972.

In each of the exemplary cleaners in these patents, a series of reciprocal buttons are selectively actuated by the user of the floor care appliance so that a desired suction pressure is produced. Further, to make button operation even more efficient, each patent contemplates the use of an automatic cancelling feature for the buttons so that only one button need be depressed for a specific bleed setting which, in turn, cancels the previous button and its particularized suction setting. Thus, less manipulative effort is required by the floor care appliance operator to obtain a desired suction pressure.

A more recent effort in the design of a pushbutton vacuum bleed system is exemplified in U.S. Pat. No. 3,779,283, issued on Dec. 18, 1973. Again, an automatic cancelling feature is provided, with initiation of the buttons of the cleaner in this patent providing a concomittant movement of valve members to obtain the desired vacuum bleed. In this respect, this patent is common with the aforementioned U.S. Pat. No. 3,566,921. These two patents also share the concept of the utilization of non-integrally or permanently connected button-actuated valve members, with the valve members moving, dependent on the initiation of a particular button. Thus, indirect operation of the valve member is provided. However, both these patents do appear to afford an advantage over the other described patent in that operator-initiated movement to actuate the valving arrangement is provided by upstanding buttons which are most easily accessible for actuation by the operator of the floor care appliance.

In contra-distinction to the indirect valve initiation action concept of U.S. Pat. Nos. 3,566,921 and 3,779,283, the aforesaid U.S. Pat. No. 3,633,239 does disclose a valving arrangement in which the valving members and the buttons are integral elements and therefore direct acting but the initiating action required by the operator of the floor care appliance is substantially parallel to the movement of the valve which slides horizontally along the housing of the cleaner. Thus, no generally upstanding, vertically acting, button members are provided which are more easily manipulated by the operator.

Accordingly, it would be advantageous to provide the direct, non-jamming action of a bleed valving arrangement such as shown in U.S. Pat. No. 3,633,239 but, at the same time, provide upstanding vertically actuated buttons which are more easily manipulated by the operator of the cleaner. At the same time, the obviously advantageous automatic cancelling feature in all three of these patents should also be retained so that overall required normal operator button manipulation is minimized, yet individual valve action effectively obtained.

It is, therefore, an object of the invention to provide a vacuum bleed system initiated by upstanding buttons, with the vacuum bleed system also having an automatic cancelling feature.

It is still a further object of the invention to provide a vacuum bleed system in which the buttons directly act to move the valve members to thereby simplify the drive arrangement therebetween.

It is a still further object of the invention to provide for selective vacuum bleed by utilizing a tunnel formed to guide button movement as a portion of the valving system to thereby eliminate the requirement for a series of apertures in the cleaner casing or in a separate valve plate leading to the casing.

It is yet another object of the invention to utilize the single entrance aperture, minimally, but absolutely required as another portion of the valving mechanism for the vacuum bleed system. From this arrangement flows a somewhat simplified vacuum bleed system with a minimum of openings through the housing of the cleaner.

SUMMARY OF THE INVENTION

The invention is provided in a canister cleaner assembly of a floor care appliance with the same including, conventionally, a motor, fan system, housing and dirt-collecting bag. Disposed on the top side of the cleaner housing is a console of controls mounted so as to extend outwardly from a control panel cover. The control panel cover houses a series of three buttons which serve as the modifying means for a bleed of atmospheric air which enters the cleaner casing to modify the suction characteristics of the cleaner.

A series of three pairs of guide means are provided extending downwardly in this console to guide the series of three buttons, mounted so as to slide within the guide means as they are moved from their upper to their lower positions. Each of the pair of guide means includes a detent means which provides a snap action for its respective button when the same is in its lowered position.

Two of the buttons include valve plate members, while the third button is utilized only to insure that the first two buttons are in the upper position when minimum suction is required. The upward urging force just mentioned is also carried through in the described structure when either of the first two buttons is actuated by being depressed so that an automatic cancelling feature is attained. It uses a pair of camming cancelling means, disposed one on each side of the middle button and between it and the button respectively disposed adjacent thereto. The buttons and cancelling members include ramp-like means which form the camming surfaces that urge an already depressed button into an upper position when another of the suction selection buttons is moved to lower active position.

The buttons are arranged so that the lowermost button gives "Minimum" cleaner suction, the middle button gives "Medium" cleaner suction and the upper button gives "Maximum" cleaner suction. Accordingly, depression of the lowermost button to give minimum suction insures that the other two buttons are in raised position so that their valving members are most removed from the aperture and/or tunnel arrangement to provide a minimum of obstruction to the flow of atmospheric air into the cleaner casing, proper.

The uppermost button includes both a horizontally extending foot acting as a valve plate and also an obstructing portion generally parallel to the vertical axis of the button. The foot portion is arranged so as to be seatable over an aperture formed in the cleaner casing so as to close the same off, generally, and provide at such time maximum suction with this button in the lower position. In its upper, inactive position, the uppermost button, it should be noted, still provides some obstruction for the tunnel arrangement so as to limit, to a certain extent, the air bleed provided to the aperture.

The middle button does not seal over any aperture contained in the cleaner casing, but merely includes a downwardly depending, extending portion which is substantially parallel to the vertical axis of the button so as to serve as an obstruction and an incomplete sealing valve plate in the tunnel when the button is in its lower position. In this position, it serves to prevent the maximum possible atmospheric air bleed from flowing through the completely open cleaner casing aperture. Of course, this button also provides a small amount of obstruction to the tunnel, in its upper position, since its depending portion does extend downwardly into the tunnel to a limited extent in this button's inoperative position.

The already mentioned third and last button which provides minimum cleaner suction (maximum bleed) contains no valve plate member to prevent the passage of air either into the tunnel or through the casing aperture. Furthermore, as has already been indicated, with this button depressed, the other two buttons are in their uppermost position so that there is minimal obstruction in the tunnel from them. In this condition, then, the floor care appliance is occasioned for minimum suction cleaning pressure.

Atmospheric bleed air easily flows to the console tunnel, both through an opening formed between the termination of the control panel cover and the adjacent cleaner casing portion and also through a gap formed between the upper portion of the control panel cover and a cord reel housing for the cleaner.

Thus, three position selection of suction cleaning power is provided by the use of three buttons initiated by the operator and acting with cancelling means so as to have an automatic cancelling feature. At the same time, the respective buttons are directly connected to their valve plate elements so that jamming therebetween is minimized, driving simplified and most positive valve action provided. Further, the push buttons are situated or deployed so as to be easily actuated by the operator as he stands adjacent to the cleaner housing casing, without resort to a more difficult horizontal actuating motion, linearly relative to the cleaner casing. At the same time, sealing is simplified since only a single aperture entrance is formed in the cleaner casing, proper.

DESCRIPTION OF THE DRAWINGS

Reference may now be had to the accompanying drawings for a better understanding of the invention, both as to its organization and function, with the illustration being of a preferred embodiment, but being only exemplary and in which;

FIGS. 4 and 5 are showings similar to FIG. 3 but illustrate alternate positions of the button and valve automatic cancelling arrangement;

DESCRIPTION OF THE PREFERRED EMBODIMENT

Figure 9:
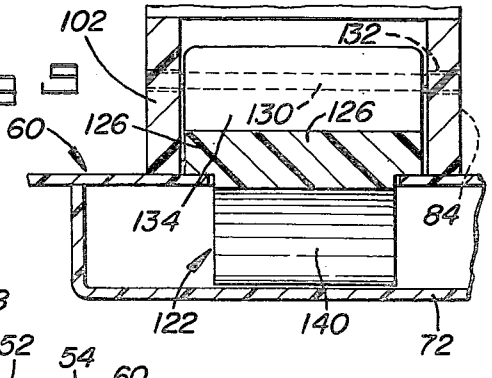
FIG. 9 is a partial cross-sectional elevational view taken generally on line 9—9 of FIG. 8.
Figure 1:
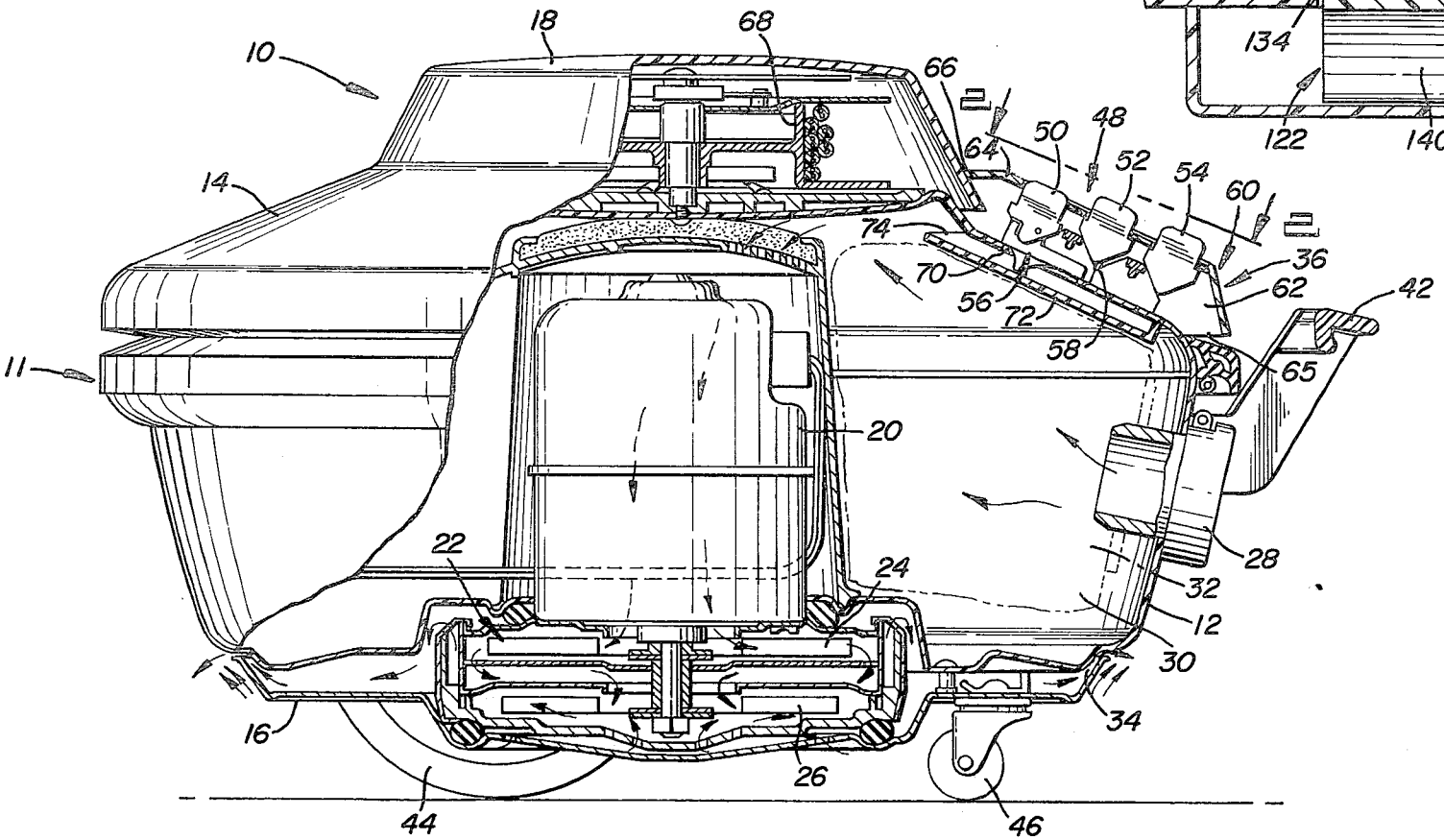
FIG. 1 is a cross-sectional view in elevation of a canister cleaner incorporating the instant invention.
Figure 2:
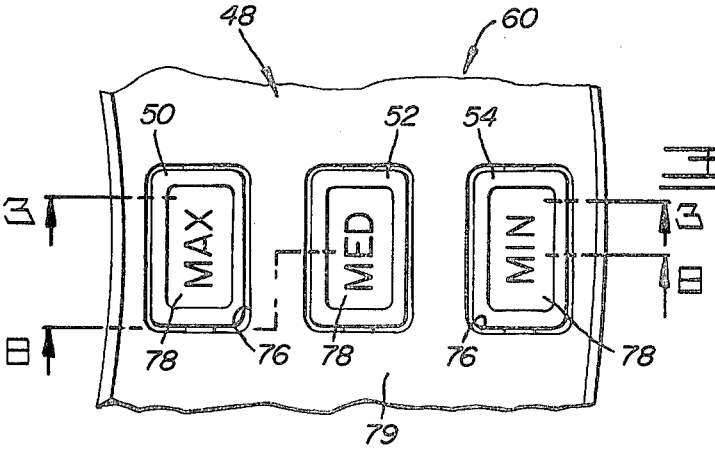
FIG. 2 is an enlarged plan view of the valve area of the cleaner including the three button actuating arrangement and taken on line 2—2 of FIG. 1.

Referring now specifically to FIG. 1 of the appended Drawings, it can be seen that a canister cleaner 10 includes a housing 11 with a hinged lid 14 mounted to a medial housing section 12. A lower housing section 16 and a medallion section 18 also cooperate in forming housing 11. A console 36 is mounted on hinged lid 14 to provide for the control of canister cleaner 10 (only a portion of the controls shown).

A motor 20 drives a pair of fans 24 and 26 of a fan system 22 to provide a suction flow of cleaning air passing into the cleaner 10 through a hose coupling fitting 28. The hose coupling communicates with a chamber 30, enclosed by housing 11, in which a dirt-collecting bag 32 is disposed so as to separate dust and dirt from the dirt-laden suction air so that relatively clean air may pass through the motor 20 for cooling the same. Air then passes through the fan system 22 for peripheral discharge between the radially outer terminations of the medial housing section 12 and the lower or bottom section 16 through an opening 34.

Cleaner 10 is supported above the floor by a pair of large rear wheels 44, (only one shown) and a mediately disposed front caster wheel 46, with a handle 42 also providing a convenient grasping means for transportation of the canister cleaner. Insofar as related, canister cleaner 10 is substantially conventional, with the inventive aspects of this Application to now be described.

A suction regulating means 48 is disposed on the hinged lid 14 of canister cleaner 10, with a series of buttons 50, 52 and 54 used for direct initiation of suction regulating means 48 and being easily accessible and manipulated by the operator-user of the canister cleaner. The series of buttons 50, 52 and 54, as set out previously, initiate direct action of attached or integral valve members 56 and 58 and also extend outwardly from a control panel cover 60, fixed to the hinged lid 14, for easy visual recognition and contact by the operator of the vacuum cleaner 10.

The valve members 56 and 58, as well as the remainder of the suction regulating means 48, are housed between the hinged lid 14 and the control panel cover 60 that may be connected to the hinged lid 14 so as to remain in fixed relation relative to the housing 11. The control panel cover 60 may also conveniently house other cleaner controls such as an on-off switch (not shown) and/or bag indicator (not shown) or any other control felt suitable for the canister cleaner 10.

Control panel cover 60 includes integral side walls 62, 62 (only one shown) which space an integral top 64 of the control panel cover 60 outwardly relative to the hinged lid 14 so that control panel cover 60, when mounted with the medial hinge lid 14 provides a box-like volume for the operative parts of the suction pressure regulating means 48.

Atmospheric bleed air enters canister cleaner 10 through an opening 65, formed between the radially outward termination of the bottom of control panel 60 and the hinged lid 14, and a slight gap 66 provided as the assembly clearance between the radially inward upper termination of control panel 60 and the medallion section 18 in which a conventional cord reel 68 is mounted. Bleed air then enters the canister cleaner housing 11, proper, through an aperture 70 of generally rectangular configuration and provided pierced through the hinged lid 14. This aperture communicates with vacuum chamber 30 through a single closed ended U-shaped cross section distribution member 72 having the open "bight" of its configuration upwardly disposed and confluent with aperture 70 to receive bleed air passing through the volume encompassed by control panel 60. Air is discharged from distribution member 72 to suction chamber 30 from its open, unobstructed end 74.

Turning now to the remaining Figures of the Drawings, it can be seen that a series of three rectangular apertures 76, 76, 76 are formed in a generally flat top wall 77 (as illustrated the same is inset somewhat for reception of a decorative bezel 79) of control panel cover 60 so that a finger-abutting portion 78 of each button 50, 52 and 54 extends therethrough so as to be easily manually manipulated. Each of the finger-abutting portions 78 of the buttons 50, 52 and 54 is formed generally in a rectangular shape at its top to provide sufficient contact area for easy engagement by the operator. A caption such as "MIN", "MED" and "MAX" may be embossed on the top side of the rectangular shape of each finger-abutting portion 78, respectively on buttons 50, 52 and 54, if desired, as indicia to guide the user-operator of the cleaner 10 so that he may select the proper button for the desired suction air characteristic which he wishes the canister cleaner 10 to possess.

Each of the finger-abutting portions 78 of the buttons 50, 52 and 54 includes a box shaped section 80 that opens downwardly and with side to side and back to front dimensioning to fit snugly within its respective rectangular aperture 76 so as to slide reciprocatorily freely therein when button action is initiated by the user of the cleaner 10. Opposite end walls of the box shaped section 80 terminate in arrowhead shaped portions 82, 82 (i.e., button 50) that are integral with the box shaped portion 80 and with the points of the arrowhead disposed downwardly. A base 84 of each arrowhead shaped portion 82 is of larger side to side dimension than the end walls of box shaped section 80 so that the buttons 50, 52 and 54, when assembled with the control panel cover 60, cannot pass completely upward through their respective button receiving apertures 76 in the control panel cover due to the abutment of the sidewardly extending legs of base 84 with portions of the inner face of top wall 77 of the control panel cover 60.

Each of the buttons 50, 52 and 54 is guided in its vertical reciprocal movement by a guide means 86 that is integrally attached to the bottom face of top wall 77 of the control panel cover and depends therefrom to receive a pair of integral, outwardly extending, guiding tabs 88, 88, formed on each arrowhead shaped portion 82 adjacent the point of the arrowhead. Each of the guide means 86 takes the form of a pair of downwardly extending short legs 90, 90 disposed adjacent each end of each of the button receiving apertures 76, in confronting, depending relation from the bottom face of top wall 77. Each inner surface of short legs 90, 90 as well as a portion of depending wall 62 forms a guide channel 92 or a groove extending substantially the full vertical height of the legs. The grooves open inwardly towards each other.

A thin ledge portion 94 interrupts each guide channel 92 intermediate its vertical height, with this ledge only extending inwardly towards the opposite confronting leg 90 for approximately one-half the depth of the guide channel 92. The pair of ledge portions 94 in each pair of guide channels 92, 92 interact with the guiding tabs 88, 88 of the respective button to form a detent means 96 to maintain the button in its active operative condition (bottom position) relative to the suction cleaning air characteristics desired at that time. More precisely, depression of one of the buttons 50, 52 or 54 towards its inner, activated position causes its guiding tabs 88, 88 to move downwardly along opposed guide channels 92, 92 until the ledges 94, 94 are encountered. Further depression of the respective button causes the guiding tabs 88, 88 to snap over the ledges 94, 94 so that the button is maintained in this position after manual pressure is removed and until a further button is activated downwardly. A pair of upper and lower angled camming surfaces 98 and 100, respectively, formed on each of the guiding tabs 88 aids in the snapping over action, one being disposed angularly in each direction of motion of the associated button. In a similar manner, each of the ledges 94 may possess angled camming surfaces (unnumbered) for each direction of travel to facilitate movement of the associated button's guiding tabs therepast.

Movement of one of the buttons 50, 52 and 54 downwardly is, of course, transferred to a corresponding automatic upwards movement of one of the other buttons. These movements are occasioned by the sliding motion transmitting members 102 and/or 104 that are disposed below the buttons 50, 52 and 54 and situated, respectively, between bottom camming portions on the buttons 50 and 52 and on the buttons 52 and 54. More specifically, center button 52 includes oppositely inclined ramp camming portions 106, 108 formed by the arrowhead shape of the button. These ramp camming portions are engageable against oppositely inclined ramp camming portions 110 and 112 formed on motion transmitting members 102 and 104, respectively; these last mentioned ramp cams conveniently being also provided by arrowhead shapes on the upper portions of motion transmitting members 102 and 104.

The arrowhead shapes of motion transmitting members 102 and 104, however, are truncated in shape to provide non-intersecting spaced ramp camming portions 110 and 114 on motion transmitting member 102 and non-intersecting spaced ramp camming portions 112 and 116 on motion transmitting member 104. By this arrangement horizontal spacing may be provided between the buttons 50, 52 and 54 so that the yielded spatial displacement avoids interference between the buttons during operation of the suction regulating means 48. It should be additionally noted that the buttons 50 and 54 also include, as a part of their arrowhead shapes, ramp camming portions 118 and 120, respectively, which act against or are acted upon by ramp camming portions 114 and 116 on motion transmitting members 102 and 104, respectively, to initiate sliding movement.

The motion transmitting members 102 and 104 are guided during their horizontal sliding movement by internal facing surfaces on the legs 90 of guide means 86, interrupted only by the spacing forming the grooves or guide channels 92 for guide means 86. Thus, the arrangement just described provides positive generally non-jamming sliding movement for the buttons 50, 52 and 54 and the motion transmitting members 102 and 104 with an inherent automatic cancelling feature for the button also obtained from the particularlized interrelated structure of the buttons and motion transmitting members.

As was originally pointed out, the valve arrangement for varying suction is directly connected to the buttons and, thus, independent, in a sense, from dependence on a valve arrangement connected indirectly to the button through the aegis of the motion transmitting members. This valving takes the form of a valve plate and obstructing baffle means 122 including a baffle 124 and a valve plate 126 attached directly to button 50 and a valve plate 128 integrally attached to button 52. The baffle 124 and valve plate 128 are generally vertically disposed so as to work in a portion of the horizontal bleed air stream passing between the top face of hinged lid 14 and the bottom face control panel cover 60 while the valve plate 126 of valve plate and obstructing baffle means 122 seals against bleed air aperture 70 in hinged lid 14. A more detailed description of these suction air modifying means is now given.

Figure 8:
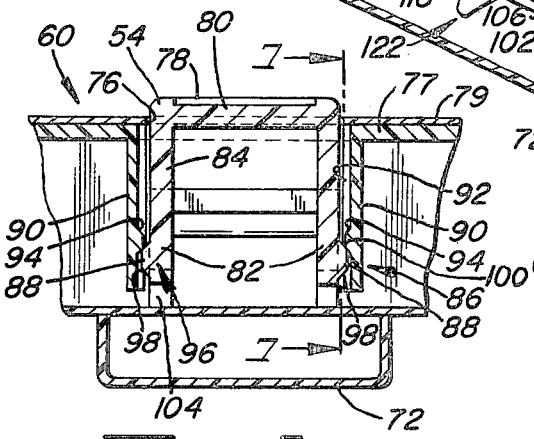
FIG. 8 is a cross-sectional elevational view of the button and valving arrangement taken on line 8—8 of FIG. 2.
Figure 7:
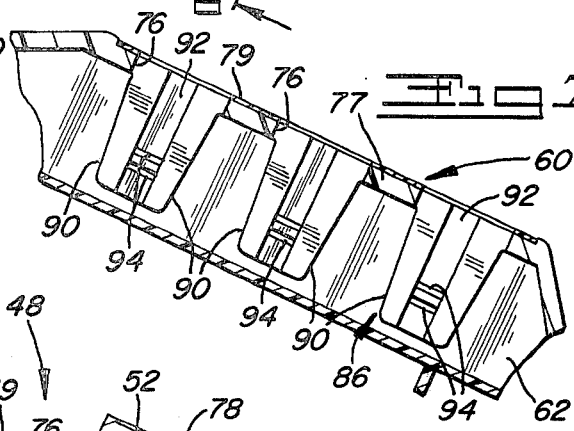
FIG. 7 is a partial cross-sectional elevational view of the invention showing the guide means on one side of the button-valve arrangement and taken on line 7—7 of FIG. 6.
Figure 9:
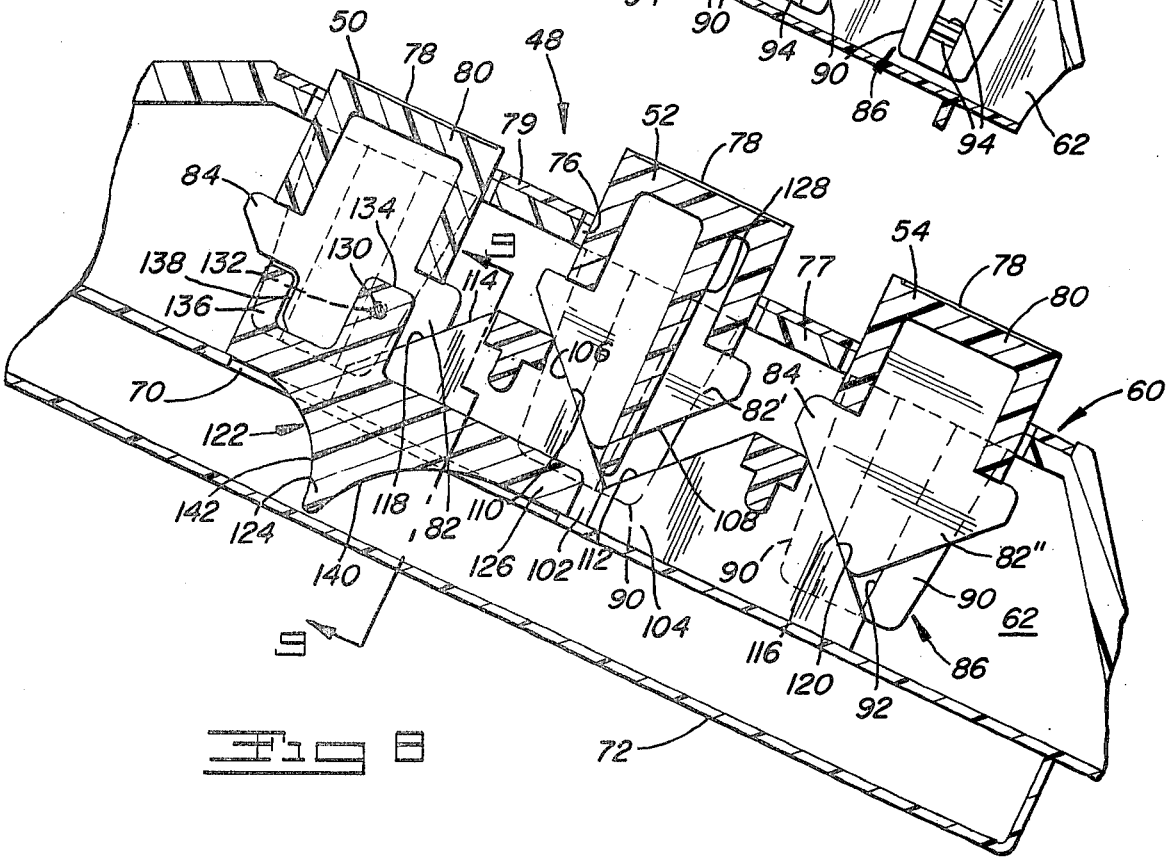

Each of the buttons 50, 52, 54 is, as before related, of hollow open box configuration so that the arrowhead shaped portions 82, 82, 82′, 82′ and 82″, 82″, respectively, on each button form confronting legs that are advantageously utilized, on button 50, e.g., to mount valve plate and obstructing baffle means 122 therebetween, the same being a solid piece having a uniform vertical cross section throughout save that the obstructing baffle 124 is somewhat inset relative to valve plate 126 to be capable of extending into the bleed hole aperture 70 and save for a slightly outwardly projecting arm 136 and best seen in FIG. 8. A pin 130 is mounted so as to extend through valve plate and baffle means 122 by an interference fit therewith with the same also extending loosely through the confronting legs of arrowhead shaped portions 82, 82 by means of bores 132 (only one shown) so as to be pivotal relative thereto and to possess self aligning attributes.

In the button 50 the guiding tabs 84 on the arrowhead shaped portions 82, 82 are off center so as to provide sufficient room for the location of the pin 130. The pin 130 mounts valve plate and baffle means 122 in depending fashion by means of a vertical upstanding leg 134, fashioned integral with it. The transversely extending arm 136, also integral with the valve plate and baffle means, projects horizontally outwardly from valve plate 126 on each side a sufficient amount to engage against a right angled notch 138 contained in each of the arrow shaped portions 82, 82 of button 52. The notches 138 thereby provide a stop to limit clockwise swinging of valve plate and obstructing baffle means 122 when the same is actively being urged in this direction by inwardly moving bleed air (with the button in inactive position).

The obstructing baffle 124 is generally scallop shaped to yield streamlined edges 140 and 142 that permit bleed air to pass therearound with a minimum of turbulence producing noise. A major portion of the bleed air, of course, flows through the "tunnel" formed generally in the volume through the open structure of the buttons 50, 52 and 54 and the motion transmitting members 102 and 104. A smaller portion of bleed air also passes behind the guide means 86, beneath the control panel cover 60 to enter bleed hole aperture 70 from the leftward side of button 50. Two streamlined air bleed guarding surfaces are therefore required to reduce noise an appreciable amount. These shaped guide surfaces on baffle 124 also interpose a larger cross sectional air flow blocking area within the aperture 70 when the button 50 is in its up position than would a baffle having the cross section of valve plate 128.

Turning to button 52, valve plate 128 integrally depends from the internal surface of finger actuating portion 78 of this button to slightly below the apexes of the arrowhead shaped portion 82, 82 so as to be positively engageable with the top surface of hinged lid 14 in its lower position. Such location of the valve plate 128 substantially terminates the bleed air flow in the aforesaid tunnel so that bleed air has only the flow passage afforded behind the guiding means 86.

Because of its abbreviated depth, relative to the vertical depth and streamlining of baffle 124, valve plate 128 is not streamlined to smooth air flow since it creates little turbulence in its up position when it inherently acts as a limited baffling means. Thus, a conventional flat valve plate may be utilized to seal off the bleed air tunnel afforded within control panel cover 60 by the structural arrangement for varying bleed air rate.

The third button 54 contains no valving or baffling structure, per se, serving merely as a cancelling means for the other two buttons when maximum air bleed is desired. However, in its down, active position the button 54 does afford a greater barrier to air flow than when it is in its up position so that it does function ever so slightly as a baffling means, absent save for its occupation of a portion of the tunnel structure of suction regulating means 48.

It should now be apparent that three separate suction pressure settings are obtainable with the structure described. When the button 50 (maximum cleaner suction effect) is depressed (FIG. 3), it forces both motion transmitting members 102 and 104 to their most rightward position raising buttons 52 and 54 and consequently valve plate 128 but, at the same time, closing valve plate 126 over aperture 70. Thus, permitting minimum bleed air flow (only leakage air) into chamber 30 and providing the highest cleaning tool air flow performance by limiting to the greatest degree bleed air and thereby maximizing the vacuum (suction pressure)

that can be provided at the cleaning tool hose coupling fitting 28 to induce air flow therethrough.

Figure 3:
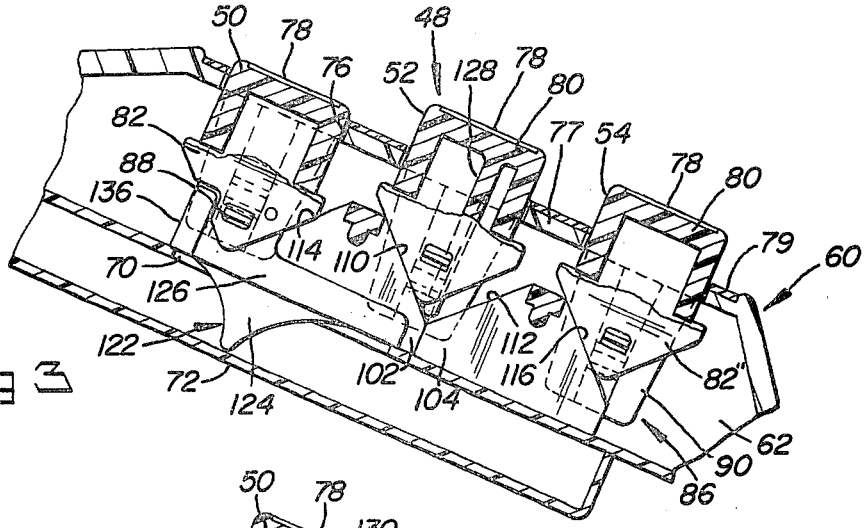
FIG. 3 is an enlarged detail cross-sectional elevational view of the button and valve cancelling arrangement as shown in FIG. 2 and taken on the line 3—3 of FIG. 2.
Figure 4:
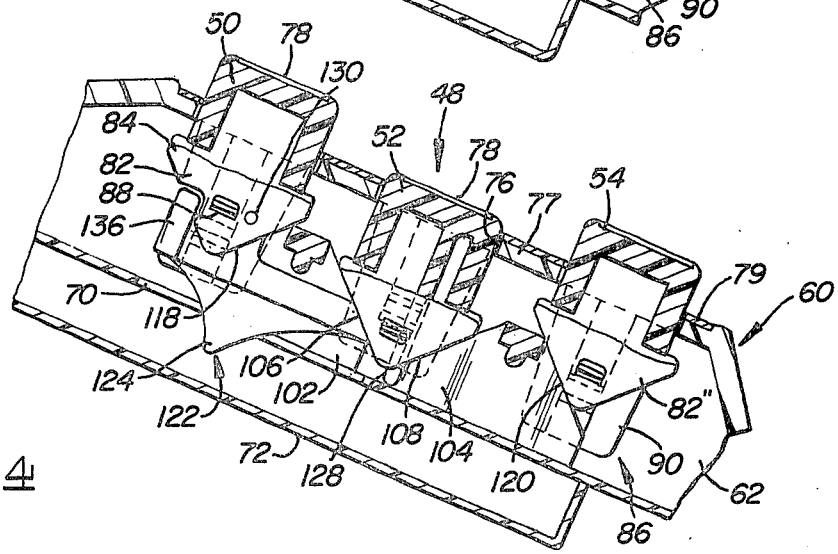
Figure 6:
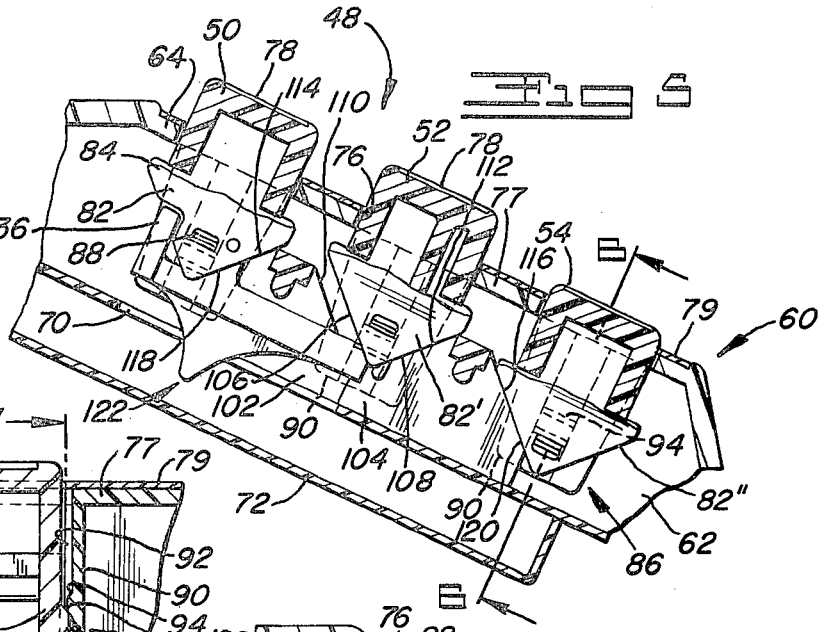
FIG. 6 is an enlarged cross-sectional elevational view of the button and guide means taken generally on line 6—6 of FIG. 5.

If an intermediate vacuum or suction pressure (FIG. 4) is desired and the suction pressure regulating means 48 is in the FIG. 3 position, the button 52 is depressed and the motion transmitting member 102 moves leftwardly as the ramp cams 106, 110 engage. Upon this leftward movement, ramp cam 114 of motion transmitting member 102 engages ramp cam 118 of button 50, camming this button and its associated valve plate 126 upwardly to an uninitiated, upper position. During this movement ramp cams 108 and 112 are finally brought into engagement to hold and maintain button 54 in its upper position. The valve plate 128, through its lowered position, closes the aforesaid tunnel so that air bleed is only around behind the guide means 86. If low suction pressure (vacuum) is then desired for minimum cleaning effect, button 54 is depressed moving motion transmitting member 104 leftwardly in FIG. 4, with the ramp cam 112 on this motion transmitting member forcing depressed button 52 upwardly with its valve plate 128. Maximum bleed air will then pass into the bag-containing chamber 30 to thereby provide lowest vacuum or suction pressure at the hose coupling member 28.

Although not all button position changes are set forth above, it should be clear that initiation of any button downwardly will cause a consequent automatic reshifting of whichever other button is in depressed position, at that time, through the movement of one or both of the motion transmitting members. Since this feature of the invention is conventional, no further description of these other shifts is deemed necessary.

It should now be obvious that the suction pressure regulating means described fulfills all the desirable advantages of such a mechanism as set out in the beginning portion of the specification. Further, it will also be apparent that many modifications could be made in the same which would still be within the spirit and purview of the described invention.

I claim:

1. A floor care appliance having a means for varying suction air flow including;

a. a housing for said floor care appliance, b. a fan arrangement in said housing for inducing a suction flow of air into said floor care appliance, c. an atmospheric air bleed aperture that is disposed in a substantially horizontal portion of said housing to open upwardly relative thereto, d. a valving arrangement disposed with said housing for selectively obstructing a flow of atmospheric air through said air bleed aperture, e. said valving arrangement including a series of substantially vertically upstanding operator actuatable push buttons, said push buttons being generally vertically displaced for actuation, f. at least a pair of said push buttons being arranged so that each is directly attached to a means for providing an obstruction to said flow of atmospheric air, g. each of said pair of push buttons including means for being acted upon to provide an automatic cancelling feature for each of said pair of push buttons, and h. means, separate from said push buttons and structurally independent of said means for providing an obstruction to said flow of atmospheric air, disposed adjacent to said push buttons for acting on said push buttons so that the same may be automatically, selectively cancelled.

2. The floor care appliance having means for varying suction as set out in claim 1 wherein;

a. one of said means for providing an obstruction to said flow of atmospheric air includes a vertically moving valve plate seatable over said atmospheric air bleed aperture.

3. The floor care appliance having means for varying suction as set out in claim 2 wherein;

a. said last named means for providing an obstruction to said flow of atmospheric air is attached to a means for baffling said flow of atmospheric air for concurrent movement of said valve plate and said means for baffling said air flow.

4. The floor care appliance having means for varying suction as set out in claim 3 wherein;

a. said means for baffling said air flow includes a depending portion forming an air barrier and attached integrally to said valve plate.

5. The floor care appliance having means for varying suction as set out in claim 4 wherein;

a. said depending portion includes at least one streamlined surface, formed by a partial scalloped shape, for reducing turbulence of said air flow.

6. The floor care appliance having means for varying suction air flow as set out in claim 5 wherein;

a. the other of said means for providing an obstruction to said flow of atmospheric air comprises a valve plate movable vertically, and b. said valve plate comprises an air impingement and barrier surface that is generally disposed so as to extend in a vertical plane, with said last named valve plate sealable against a portion of said housing.

7. The floor care appliance having means for varying suction air flow as set out in claim 6 wherein;

a. said last named valve plate is integrally attached to its respective push button.

8. The floor care appliance having means for varying suction air flow as set out in claim 7 wherein;

a. said one of said means for providing an obstruction to said flow of atmospheric air is pivotally attached to its respective push button.

9. The floor care appliance having means for varying suction air flow as set out in claim 8 wherein;

a. each of said push buttons include guiding tabs, b. guiding channels are fixed with respect to said housing within which said guiding tabs engage, and c. said guiding tabs insure easy movement of said buttons along said guiding channels.

10. The floor care appliance having means for varying suction as set out in claim 9 wherein;

a. said valving arrangement is disposed beneath a cover carried with said housing, b. said cover includes at least one opening for the entrance of atmospheric air, c. the flow of said atmospheric air within said cover is between said cover and said housing and from said opening to said upwardly opening air bleed aperture, and d. said means for baffling said air flow includes a second streamlined surface of partially scalloped shape, said first and second streamlined surfaces being on opposite sides of said last named means thereby reduce turbulence of atmospheric air flow to either side of said last named means.

11. A floor care appliance having means for varying suction air flow including;

a. a housing for said floor care appliance, b. a single aperture in said housing for the admittance of bleed air, c. a motor and fan system within said housing for inducing suction air flow into said housing, d. a valving arrangement carried with said housing that modulates the flow of bleed air into said housing, e. said valving arrangement driven by a series of operator actuatable push buttons, f. said push buttons directly driving portions of said valving arrangement to modulate said flow of bleed air, g. means for providing an automatic cancelling feature for said push buttons, separate from said valving arrangement and said push buttons, and h. portions of said valving arrangement including means for sealing said single aperture in said housing for providing one modulated flow of bleed air to said housing and separate means vertically imposable in the path of said bleed air and abuttingly sealing against said housing for providing a second modulated flow of bleed air to said housing.

12. The floor care appliance having means for varying suction air flow as set out in claim 11 wherein;

a. said means for sealing said single aperture includes streamlined means for baffling said path of bleed air, and b. said separate means for abuttingly sealing against said housing being sealable against said housing only when said means for sealing said aperture is in non-sealing position.

13. A floor care appliance having a means for varying suction air flow including;

a. a housing for said floor care appliance, b. a fan arrangement in said housing for inducing a suction flow of air into said floor care appliance, c. a single atmospheric air bleed aperture in direct communication with the interior of said housing and opening outwardly relative thereto for the entrance of bleed air, d. a valving arrangement disposed closely adjacent to said housing and upstream of said single atmospheric air bleed aperture for selectively obstructing a flow of atmospheric air to said air bleed aperture, e. said valving arrangement including a series of operator actuatable push buttons extending outwardly from said housing, said push buttons being disposed for easy operator actuation, f. at least a pair of said push buttons being arranged so that each is directly attached to a means for providing an obstruction to said flow of atmospheric air, g. each of said pair of push buttons including means for being acted upon to provide an automatic cancelling feature for each of said pair of push buttons, and h. means, separate from said push buttons and structurally independent of said means for providing an obstruction to said flow of atmospheric air, disposed adjacent to said push buttons for acting on said push buttons so that the same may be automatically selectively cancelled.

14. A floor care appliance having a means for varying suction air flow including;

a. a housing for said floor care appliance including a single ingress thereto for bleed air movement, b. a fan arrangement in said housing for inducing a suction flow of air into said floor care appliance, c. a supplementary housing mounted with said floor care appliance housing and including at least one opening communicating with atmosphere for the entrance of atmospheric bleed air, d. said supplementary housing forming at least a portion of a flow passageway for the flow of said bleed air, e. a valving arrangement within said supplementary housing for obstructing bleed air flow, f. said bleed air, when unobstructed by said valving means, moving through said supplementary housing, said single housing ingress and into said fan arrangement, g. said valving means including a first valve plate movable into blocking position directly over said housing ingress for sealing the same and a second valve plate, in series flow relationship with said first valve plate, situated generally removed from said ingress and movable across said flow of bleed air in the passageway formed at least partly by said supplemental housing to thereby provide a major obstruction to its flow, h. operator actuated buttons for initiating movement of said first and second valve plates, and i. means provided adjacent said buttons for moving a previously actuated button to non-actuated position upon operator initiated activation of a differing button.

15. The floor care appliance having a means for varying suction air as set out in claim 14 wherein;

a. said first valve plate includes another flow obstructing portion attached thereto and extending transversely thereof, and b. said other obstructing portion is in an active blocking interference with bleed air flow when said second valve plate is in its obstructing, bleed air flow impeding position.

* * * * *